US007062833B2

(12) United States Patent
Schann et al.

(10) Patent No.: US 7,062,833 B2
(45) Date of Patent: Jun. 20, 2006

(54) METHOD AND INSTRUMENT FOR UNLOCKING A DEVICE HAVING TWO AXIALLY LATCHED BODIES

(75) Inventors: Christian Schann, Oberhausbergen (FR); Gerard Muller, Urmatt (FR); Frédéric Reynes, Molsheim (FR); Christian Clauss, Obernai (FR)

(73) Assignee: Millipore Corporation, Billerica, MA (US)

( * ) Notice: Subject to any disclaimer, the term of this patent is extended or adjusted under 35 U.S.C. 154(b) by 156 days.

(21) Appl. No.: 10/491,058

(22) PCT Filed: Oct. 9, 2002

(86) PCT No.: PCT/EP02/11339

§ 371 (c)(1),
(2), (4) Date: Mar. 29, 2004

(87) PCT Pub. No.: WO03/033215

PCT Pub. Date: Apr. 24, 2003

(65) Prior Publication Data

US 2004/0237274 A1 Dec. 2, 2004

(30) Foreign Application Priority Data

Oct. 12, 2001 (FR) ..... 01 13186

(51) Int. Cl.
*B23P 19/00* (2006.01)
*B23P 19/04* (2006.01)

(52) U.S. Cl. ..... 29/426.5; 29/426.1; 29/426.6; 29/237; 29/239

(58) Field of Classification Search ..... 29/426.1, 29/426.5, 426.6, 235, 237, 270, 272, 239; 294/99.1, 99.2
See application file for complete search history.

(56) References Cited

U.S. PATENT DOCUMENTS

| | | | | | |
|---|---|---|---|---|---|
| 4,283,826 | A | * | 8/1981 | Miller | 29/252 |
| 4,927,185 | A | * | 5/1990 | McNaughton | 285/39 |
| 5,005,279 | A | * | 4/1991 | Kooiker | 29/426.5 |
| 5,024,468 | A | * | 6/1991 | Burge | 285/39 |
| 5,084,954 | A | * | 2/1992 | Klinger | 29/237 |
| 5,378,025 | A | * | 1/1995 | Szabo | 285/39 |
| 5,455,995 | A | * | 10/1995 | Pool | 29/237 |
| 5,496,073 | A | * | 3/1996 | Grenier | 285/39 |
| 5,529,426 | A | | 6/1996 | Masuda et al. | 403/329 |
| 5,533,761 | A | * | 7/1996 | Ostrander et al. | 285/38 |
| 5,937,498 | A | | 8/1999 | Ploeger et al. | 29/426.6 |

FOREIGN PATENT DOCUMENTS

| | | |
|---|---|---|
| EP | 0 409 347 | 1/1991 |
| EP | 0 491 304 | 6/1992 |
| FR | 2 802 942 | 6/2001 |
| FR | 2 802 943 | 6/2001 |

* cited by examiner

*Primary Examiner*—Essama Omgba
(74) *Attorney, Agent, or Firm*—Nields & Lemack

(57) ABSTRACT

The method includes the step of positioning the device on a sheath (94) having, for each latching tab (7), a portion adapted to be housed between this tab and a cylindrical wall of the device; the step of making the sheath enter between each tab and the cylindrical wall until means preventing the withdrawal of the tabs are released; and the step of moving the two bodies (2,3) away from each other. The instrument has, in addition to the sheath (94), a guidance slide (77).

29 Claims, 7 Drawing Sheets

Fig. 10

METHOD AND INSTRUMENT FOR UNLOCKING A DEVICE HAVING TWO AXIALLY LATCHED BODIES

BACKGROUND OF THE INVENTION

The invention relates to the opening of devices with two bodies locked by latching, and notably to the opening of devices for the microbiological examination of a liquid sample under pressure.

Through French patent applications 2 802 942 and 2 802 943, such a device which has an intake body, a filtering membrane and a drainage body is already known. The intake body has a reservoir, in one wall of which a liquid inlet orifice is provided, the membrane closing off this reservoir, the drainage body being designed to support the membrane on the opposite side to the reservoir and being provided with a liquid outlet orifice, the intake body and the drainage body locking on each other by means of latching in the axial direction, the membrane being gripped annularly at the periphery between an annular transverse wall of the drainage body situated around means with which this body is provided for supporting the membrane and the lateral wall of the reservoir of the intake body, which lateral wall has an elastomer joint which forms the edge and through which this wall comes into contact with the membrane, this joint, although it is present on only one of the faces of the membrane, making it possible to obtain a seal on the two faces of the latter, because of the simple fact that the above mentioned two walls grip the membrane.

The taking of a sample to be examined is effected by connecting the inlet orifice of the reservoir of the intake body to a pressurised liquid source, so that the reservoir fills with this liquid, which can leave it only through the filtering membrane, this liquid being recovered on the other side of the membrane by the drainage body and discharged out of the latter through the outlet orifice. The latching means in the radial direction, serving to lock the intake body and the drainage body to each other, have, on the intake body, a plurality of axially oriented projecting latching tabs and, on the drainage body, a transversely oriented wall and provided for each latching tab with an aperture through which this tab can pass, the transversely oriented wall being connected to a cylindrical wall which the latching tabs face when the intake body and the drainage body are locked on each other. To prevent the withdrawal of each latching tab which has passed through an aperture in the transversely oriented wall, there is provided, on this wall, an axially oriented tooth bordering the aperture on the cylindrical wall side and, on the latching tab, a groove adapted to house this tooth.

BRIEF SUMMARY OF THE INVENTION

The invention is aimed at making it possible to unlock devices of this type in a simple and convenient fashion.

For this purpose it proposes a method for unlocking a device having a first body and a second body provided with means of mutual locking by axial latching, said mutual locking means having:

on said first body, a plurality of axially oriented projecting latching tabs;

on said second body, a transversely oriented wall provided, for each said latching tab, with an aperture through which this latching tab can pass, said transversely oriented wall joined to a cylindrical wall faced by said latching tabs when said first body and second body are locked on each other; and means for preventing the withdrawal of each latching tab which has passed through a said aperture;

the method characterised in that it includes:

a) the step of positioning said device on a sheath having, for each said tab, a portion adapted to be housed between this tab and said cylindrical wall, b) the step of making each said portion of said sheath enter between a said tab and said cylindrical wall so that each said portion cooperates with a said tab in order to cause it to tilt until said means for preventing withdrawal are released; and c) the step of separating said first body and second body from each other.

The sheath which implements the method according to the invention offers the advantage of making it possible to act simultaneously on the respective latching tabs, which will therefore each be unlocked in a single movement.

It will be noted that, compared with a successive unlocking of the latching tabs, the method according to the invention offers the advantage of avoiding the risk that one of the tabs will leave the unlocking position whilst the other one is in the process of being unlocked, and particularly the advantage that a single simple movement suffices instead of several complicated movements.

According to preferred characteristics, said sheath is formed by a continuous cylindrical wall.

It is therefore avoided having to comply with a precise angular positioning between the sheath and the device to be unlocked, unlike that which would occur if the sheath had for each tab a solid portion separated from the other portions by a void.

According to other preferred characteristics, said sheath forms part of an unlocking instrument also having a guidance means adapted to move with respect to said sheath in the axial direction, in that said step a) includes a step of positioning said second body on said guidance means and in that said step b) includes a movement of said guidance means with respect to said sheath in order to guide, with respect to said sheath, the second body, and therefore the cylindrical wall, in the axial direction.

It thus suffices for the operator, in order to proceed with unlocking, to exert an abutment on the device, without having to hold the latter laterally in order to guide the second body with respect to the sheath.

Preferably, in order to improve the simplicity and convenience of the unlocking operation still further, by virtue of the presence of the guidance means:

the said unlocking instrument has means for at least assisting the movement of said guidance means during step b); and in particular said unlocking instrument has means of connection to a vacuum source, a piston means forming part of the guidance means, a drive chamber delimited at one end by said piston means and distribution means for selectively connecting said drive chamber to said vacuum source or to isolate it from it; and in that said step a) is performed with said distribution means which isolate said drive chamber from the vacuum source whilst said step b) is performed with said distribution means which connect said drive chamber to the vacuum source; and/or said second body has a table surrounded by said transversely oriented wall and provided at its centre with a drainage orifice; in that said guidance means has a suction chamber adapted, when said second body is in place on said guidance means, to be closed by said table with said drainage orifice opening out into said suction chamber; in that said unlocking instrument has means of connection to a vacuum source and distribution means for selectively connecting said suction chamber to said vacuum source or to isolate it from it; and in that said method includes the step of connecting said suction chamber to said vacuum source in order to drain said device before unlocking; and/or said second body has a table with a first cylindrical wall and a second cylindrical wall disposed coaxially and extending opposite to the first wall when it is locked on the second body, and having a transversely oriented annular wall whose external end and internal end are connected respectively to the first cylindrical wall and the second cylindrical wall; with said guidance means having a wall whose rim close to the edge is adapted to be housed in the space delimited by said transversely oriented annular wall and by said first cylindrical wall and second cylindrical wall; and in that said step a) includes the step of engaging said rim close to the edge in said space.

The invention also relates, in a second aspect, to an unlocking instrument suitable for implementing the method which has just been disclosed.

The explanation of the invention will now be continued with the description of an example embodiment, given below as a non-limitative illustration, with reference to the accompanying drawings. In these:

DETAILED DESCRIPTION OF THE INVENTION

Figure 1:
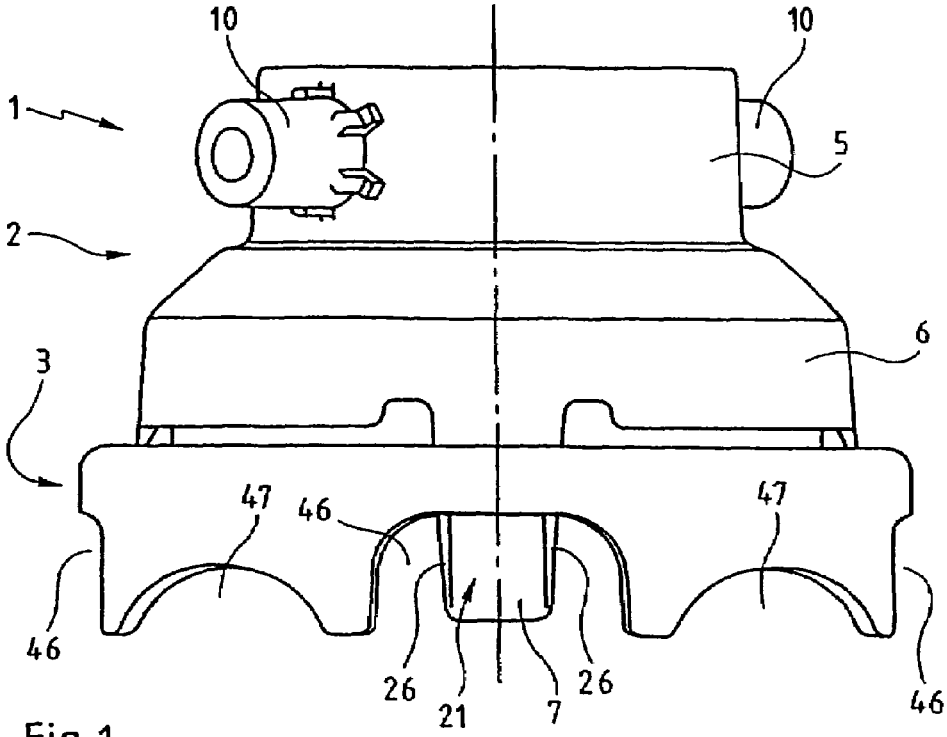
FIG. 1 is an elevational view of a device suitable for being unlocked according to the invention.
Figure 2:
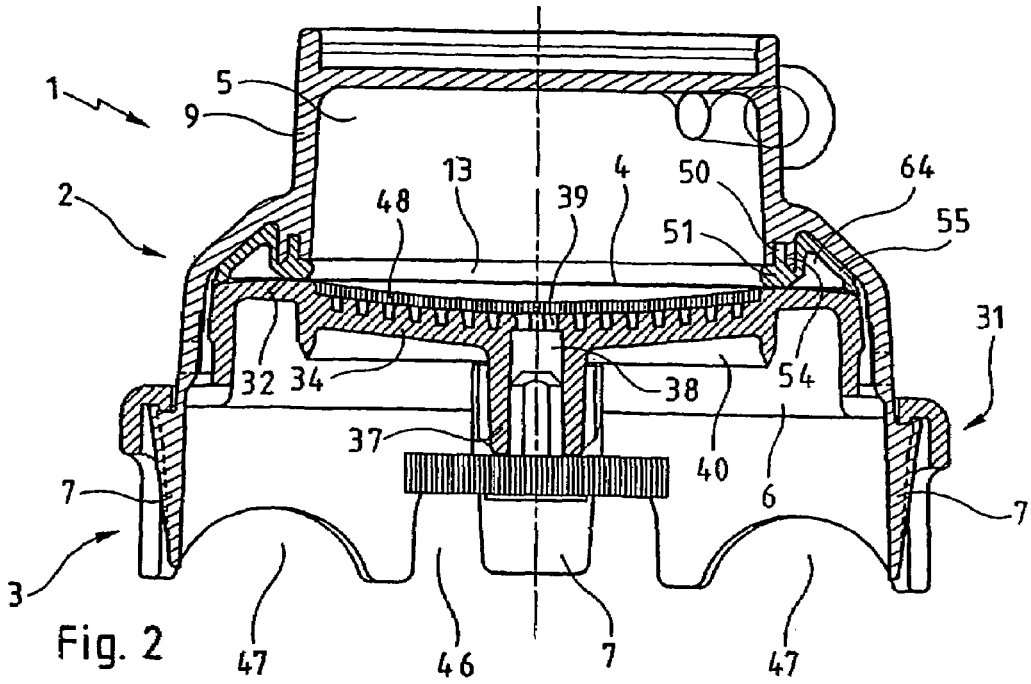
FIG. 2 is a sectional elevational view of this device.

The device 1 for microbiological examination of a sample of liquid under pressure shown in the drawings, and notably in FIGS. 1 and 2, has in general terms a symmetry of revolution around a central axis. It has an intake body 2, a drainage body 3 and a filtering membrane 4.

The intake body 2 has a reservoir 5, a skirt 6 which is connected externally to the reservoir 5 and four latching tabs 7 which extend projecting from the skirt 6, in an axial direction.

The reservoir 5 has an end wall 8 and a lateral wall 9.

Two diametrically opposite pipes 10 extend projecting outward from the lateral wall 9, above the skirt 6, each of these pipes constituting a female Luer connector adapted to receive internally, in order to sample a liquid under pressure, a male Luer connector, the passage internal to each pipe 10 being continued by an aperture 11 made in the wall 9, this aperture being in immediate proximity to the end wall 8.

The lateral wall 9 finishes at the end opposite the end wall 8 in an edge forming part of a seal 13, a groove 14 being made to that effect in the rigid part of the wall 9, as will be explained in more detail subsequently with the help of FIGS. 2, 3, 6 and 7.

The skirt 6 is connected to the reservoir 5 by the outside of the lateral wall 9, at a level situated between the groove 14 and the pipes 10, the skirt 6 having a truncated-cone shaped wall 15 and a cylindrical wall 16, the skirt 6 being connected to the wall 9 by the small-diameter end of the wall 15 while the connection between the walls 15 and 16 is made by the large-diameter end of the wall 15, the connection between the walls 15 and 16 being situated approximately at the level of the edge of the wall 9.

Each of the latching tabs 7 has a general outline in the form of a trapezium symmetrical with respect to the axial direction, the side forming the free end 18 of the tab 7 being parallel to the one by which this tab is connected to the skirt 6, and more precisely to the edge of the wall 16, the tab 7 narrowing steadily between its connection to the skirt 6 and its free end.

On either side of each tab 7, a notch 17 is made in the wall 16, over a certain distance from the edge thereof.

Each tab 7 has, from its free end 18, an internal surface 19 which is straight, that is to say parallel to the axial direction, as far as a dihedral 20 from which the surface 19 is inclined inward and towards the wall 16.

As for the external surface 21 of each tab 16, this is inclined outward and towards the wall 16, the surface 21 extending between the surface 18 and a transversely oriented surface 22 which connects the surface 21 and a groove 23 situated between an external shoulder 24 whose surface 22 constitutes the edge and a surface 25 offset inward with respect to the surface 21, the surface 25 being in the continuation of the external surface of the wall 16.

It should be noted that the portion of each tab 7 situated between the bottom of the groove 23 and the edge of the wall 16 has a thickness which is a minimum at the level of the dihedral 20.

As can be seen more particularly in FIG. 1, the surface 21 has edges parallel to the axial direction, each tab 7 having a notch 26 with an L-shaped profile between the lateral edges of the surface 21 and the lateral edges of the tab 7.

Figure 4:
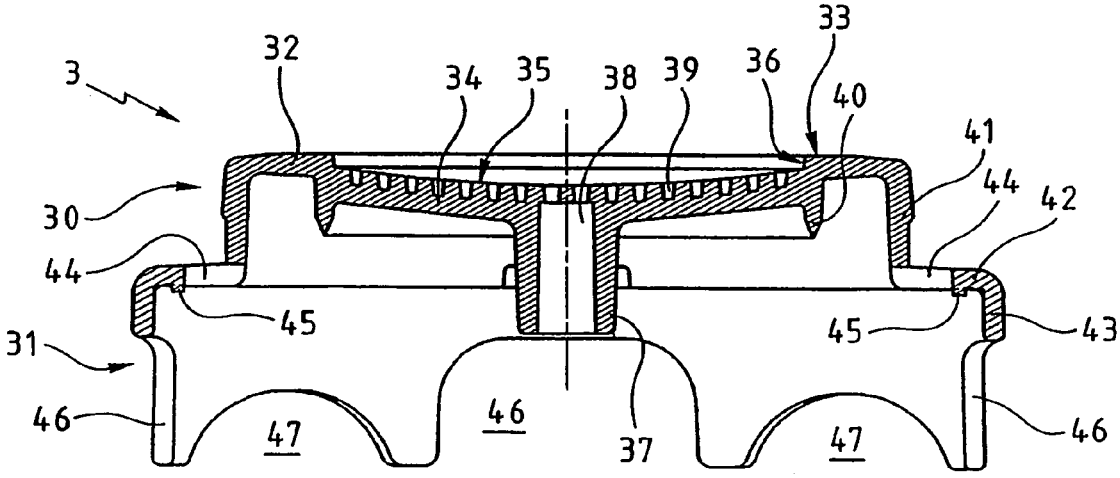

As can be seen better in FIG. 4, the drainage body 3 has a circular table 30 and a skirt 31 disposed in a step around the table 30.

The latter has an annular transverse wall 32 delimited on the opposite side from the skirt 31 by a surface 33 which is flat in the main but having a slight bevel towards the outside.

The internal periphery of the wall 32 is connected to a wall 34 delimited, on the side of the surface 33, by a surface 35 which is concave in the main, offset with respect to the surface 33 in the axial direction, towards the skirt 31, the perimeter of the surface 35 and the internal periphery of the surface 33 being connected by a slightly truncated-cone shaped surface 36.

The wall 34 is connected centrally to a pipe 37 whose internal passage is extended into the wall 34 by an output aperture 38, concentric drainage channels 39 being put into the wall 34 from the surface 35, radially oriented channels (not visible in the drawings) also being made, with the same depth as the channels 39, these radial channels opening of course into the output aperture 38, through which, therefore, there flows out all the liquid drained by the channels made in the wall 34 hollowed out with respect to the surface 35.

At the junction between the walls 32 and 34 there is situated an annular rib 40 which projects with respect to the walls 32 and 34 on the side of the skirt 31, this rib tapering towards its free end in a V-shaped profile, so that this end constitutes a sharp edge.

The table 30 also has a cylindrical lateral wall 41 which is connected by one end to the wall 32 while, by the other end, it is connected to the skirt 31.

The latter has a transversely oriented annular wall 42 and an axially oriented cylindrical wall 43, the wall 42 being connected by one of its ends to the wall 41 and by the other to the wall 43.

In the wall 42, in proximity to the wall 41, four openings 44 are made, which have between them the same angular spacing as between the latching tabs 7, that is to say they are spaced out from one another by 90°, these openings having an outline corresponding to the largest outline of the tabs 7, so that the latter can each pass through a respective opening 44.

Each opening 44 is bordered on the external side by an axially oriented tooth 45 projecting on the opposite side from the table 30.

Figure 5:
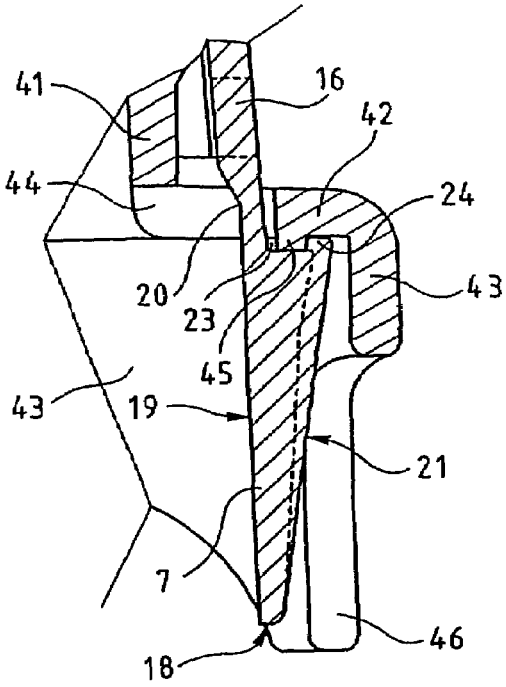
FIG. 5 is an enlargement of the part of FIG. 2 situated at the bottom right.

Each tooth 45 extends projecting over a height corresponding to the depth of the groove 23 and has a thickness less than the width of the groove 23, the distance separating each tooth 45 from the wall 43 being greater than the thickness of the shoulder 24 (see FIG. 5).

At the level of each opening 44, the wall 43 has a notch 46 of general rectangular form with rounded corners, extending over approximately two thirds of the height of the wall 43 and over a width which is approximately twice the width of the latching tabs 7.

The wall 43 also has four notches 47, each disposed halfway between two successive notches 46, the notches 47 having a rounded form whose maximum height corresponds approximately to one third of the height of the wall 43.

The drainage body 3 also has a porous pad 48 (not depicted in FIG. 4), which has a constant thickness with two opposite surfaces of the same form as the surface 35, its diameter and thickness being the same as those of the surface 36.

When the filtration body 2, the drainage body 3 and the membrane 4 are assembled, as shown notably in FIGS. 1 and 2, the membrane 4 is gripped between the edge of the lateral wall 9 of the reservoir 5 of the intake body 2 and the surface 33 of the wall 32 of the circular table 30 of the drainage body 3, the bodies 2 and 3 being locked to one another by virtue of the latching tabs 7 and the skirt 31, which are mutually disposed as can be seen more particularly in FIG. 5.

It should be noted that the tooth 45 of the wall 42 fits into the groove 23 of the tab 7 and that the shoulder 24 of this tab fits into the space situated between the wall 43 and the tooth 45, so that the cooperation between the shoulder 24 and the tooth 45 provides an extremely powerful locking of the tab 7 in the skirt 31, capable of withstanding relatively large forces tending to move the bodies 2 and 3 away from one another.

It should also be noted that the end 18 of the tab 7 is recessed with respect to the free end of the wall 43, so that, when the device 1 is put down on a surface with the drainage body 3 at the bottom, it is by means of the skirt 31 thereof that the device 1 rests on this surface, no force being exerted for this reason on the tabs 7.

Figure 3:
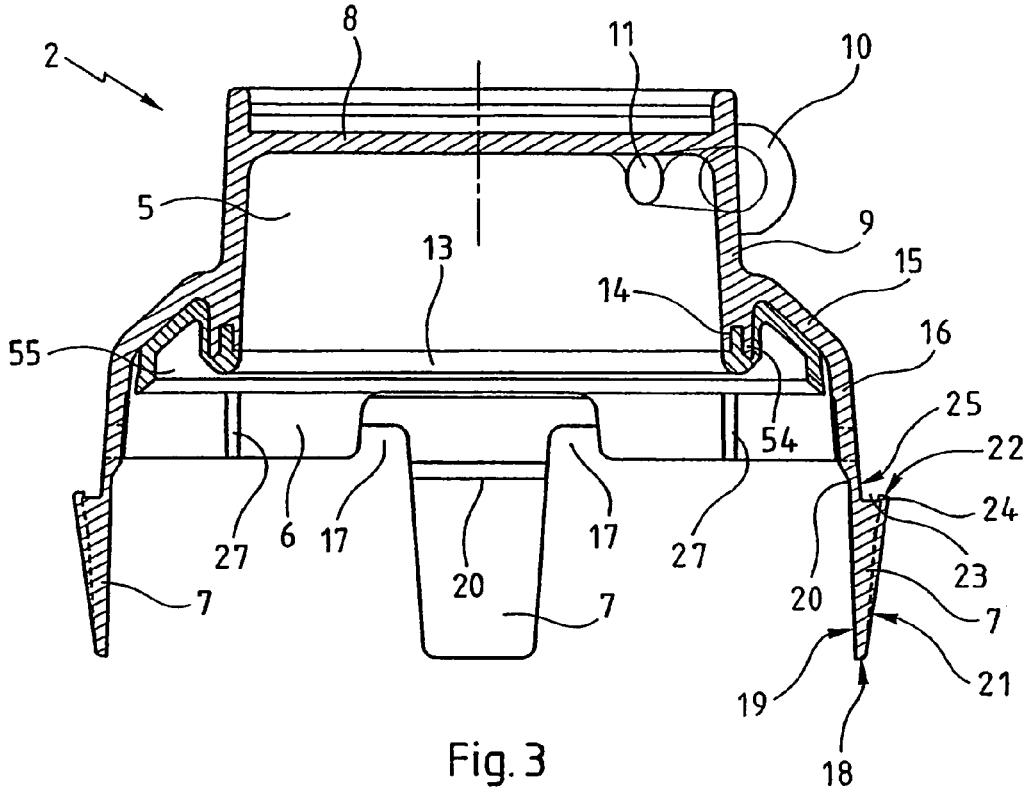
FIGS. 3 and 4 are similar views but showing, respectively, only the intake body and the drainage body.
Figure 7:
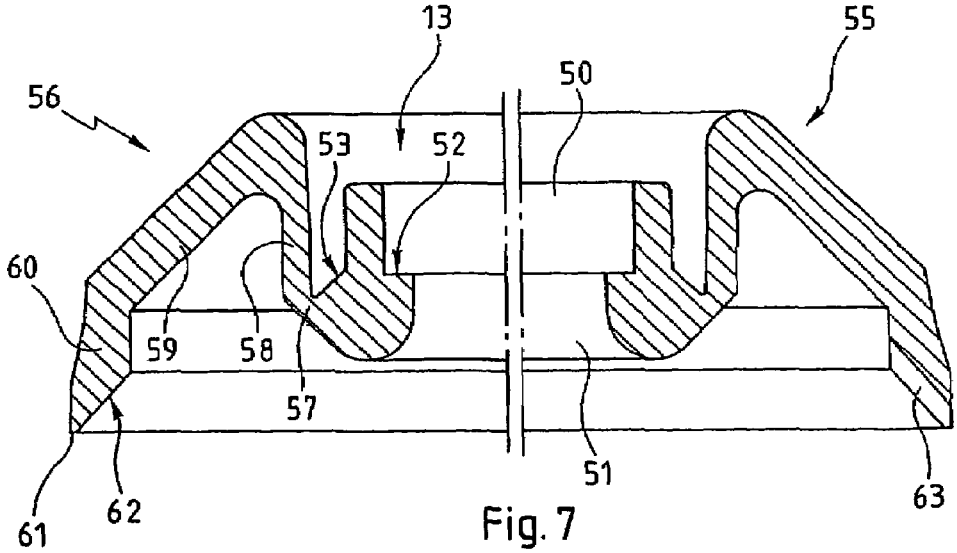
FIG. 7 is the sectional elevational view marked by VII—VII in FIG. 5, shown enlarged.

As can be seen in FIG. 2, when the device 1 is assembled, the seal 13, and more particularly the cushion thereof, is highly compressed compared with the off-load form shown in FIGS. 3 and 7.

This seal has a T-shaped general profile whose longitudinal branch forms a rib 50 designed to be inserted into the groove 14 and whose transverse branch forms a cushion 51 designed to enter into contact with the membrane 4.

It will be noted that the junction between the rib 50 and the cushion 51 is made by a straight surface 52 on the internal side while, on the external side, there is a bevel 53.

This bevel in fact corresponds to a chamfered lip 54 at the external periphery of the end of the rigid part of the wall 9, this chamfered lip making it possible to laterally contain the cushion 51 on the external side in order that it flows mainly inward, that is to say towards the chamber delimited by the membrane 4 and the reservoir 5.

In the uncompressed state, the cushion 51 has a profile whose free part, opposite to the rib 50 and to the surfaces 52 and 53, is, on the outside, rectilinear and inclined towards the outside and towards the rib 50; is, on the inside, rectilinear and oriented in the axial direction; and is, between the internal side and the external side, rounded in an arc of a circle. In the compressed state (FIG. 2), the internal side is curved whilst the part situated between the internal side and the external side, a part which is in contact with the membrane 4, is rectilinear, as is the surface 33 on which the membrane rests at this point.

It will be observed that the peripheral area of the membrane, that is to say the one which is situated radially more towards the outside than the porous pad of the support 48, is not limited to the annular portion gripped between the edge of the lateral wall 9, formed by the seal 13, and the surface 33 of the wall 32, but also has, radially further out, an annular portion disposed opposite the surface 33, extending between the portion which is gripped and the external end of the membrane 4, which is situated a little to the right of the internal surface of the wall 41.

Figure 6:
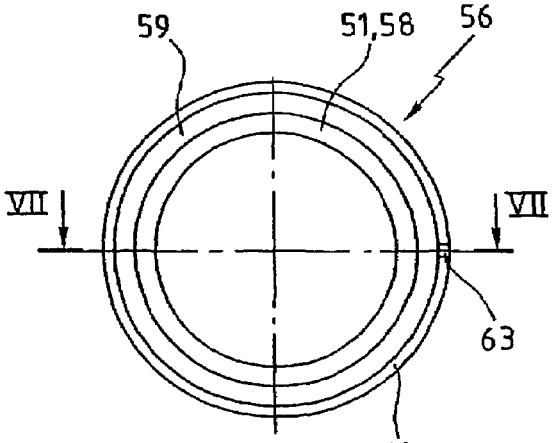
FIG. 6 is a view from below of the sealing ring with which the intake body is provided.

In order to protect this last annular portion from contamination by micro-organisms, in addition to the joint 13, a second joint 55 is provided, which has an arched profile, the external annular end of which bears against the surface 33 radially beyond the membrane 4, and whose internal annular end is connected to the seal 13, by the annular periphery thereof, the seals 13 and 55 forming together the sealing ring 56 shown in detail in FIGS. 6 and 7.

The seal 55 has, from the internal annular end 57, a cylindrical wall 58 whose internal diameter corresponds to the external diameter of the rigid portion of the wall 9 situated between the seal 13 and the skirt 6. At its end opposite to the end 57, the cylindrical wall 58 is connected, by a rounded part, to the small-diameter end of a frustoconical wall 59 whose external surface has a conformation similar to the internal surface of the frustoconical wall 15 of the skirt 6, with the small diameter of the external surface of the wall 59 corresponding to the small diameter of the internal surface of the wall 15, the large diameter of the external surface of the wall 59 on the other hand being slightly smaller than that of the internal surface of the wall 15.

The wall 59 is connected, at its end opposite to that which is connected to the wall 58, to a roughly cylindrical wall 60 which forms, opposite to its connection with the wall 59, the external peripheral end 61 of the seal 55.

The wall 60 has, on the inside, as from the end 61, a bevel 62.

It will be observed that the end by means of which the wall 60 is connected to the wall 59 is situated approximately at the same level as the external periphery of the bevel 53 and that the internal edge of the bevel 62 is situated approximately at the same level as the limit of the cushion 51 opposite to the rib 50.

Because of the dimensional characteristics which have just been disclosed, and as can be seen in FIG. 2, when the device 1 is in the assembled state, the walls 58 and 59 of the joint 55 are respectively in abutment against the external surface of the wall 9 and against the internal surface of the wall 15, whilst the portion 60 is compressed between the wall 32 and the wall 59 which is in abutment against the wall 15.

By virtue of its conformation, and in particular by virtue of the presence of the bevel 62, the wall 60 behaves like a lip which is crushed against the surface 33 of the wall 32.

A slot 63, with approximately constant and identical depth and width, is provided from the bevel 62 over the entire thickness of the wall 60. As explained below, this slot then serves for the sterilisation of the device 1, as a channel for the sterilisation agent.

Figure 8:
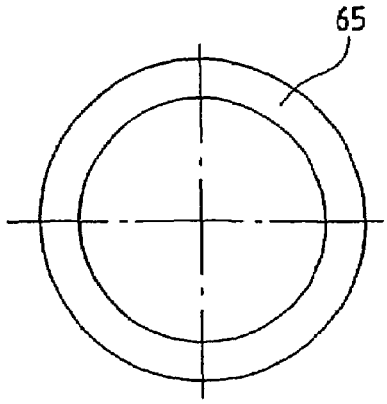
FIG. 8 is a plan view of the screen ring interposed, in the embodiment illustrated, between the membrane and the sealing ring, shown to the same scale as the latter in FIG. 6.

The screen ring 65, illustrated only in FIG. 8, is formed from a very thin film of polypropylene. Its internal diameter corresponds to the internal diameter of the edge of the lateral wall 9 of the reservoir 5, that is to say to the internal diameter of the cushion 51 when the seal 13 is not compressed, whilst the external diameter of the ring 65 corresponds to the internal diameter of the part of the wall 60 situated between the bevel 62 and the connection to the wall 59.

It is by means of the ring 65 that the joint 13 comes into contact with the membrane 4, the ring 65 being interposed between the membrane and this joint. The screen which constitutes the ring 65, because it is made from polypropylene, prevents the migration to the membrane 4 of the constituents of the elastomer material from which the sealing ring 57 is made, these constituents being liable to impair the correct growth of the micro-organisms on the membrane 4 when the latter, subsequent to the sampling operation, is put to incubate.

In addition, the screen ring 65, still because of the material from which it is made, prevents the adhesion and/or sticking of the membrane 4 to the seal 13, which could pose difficulties of recovery, or even damage to the membrane, when the device 1 is opened and the membrane is extracted from it.

In the example illustrated, a surface treatment has been carried out on the face of the ring 65 situated on the same side as the seal 13, so that the ring 65 is held on the seal 13, which facilitates still further the operations of opening the device 1 and recovering the membrane 4.

The intake body 2 is obtained, with the exception of the seal 13, by moulding a relatively rigid and transparent plastic.

The part of the drainage body 3 depicted in FIG. 4 is also made of relatively rigid moulded plastic, here white in colour, this part being next equipped, by simple fitting, with the porous pad 48.

In order to assemble the intake body 1, the drainage body 3 and the membrane 4, the latter is put on the table 30, concentrically therewith, then the intake body 2 is positioned facing the drainage body 3 with the latching tabs 7 aligned with the openings 44, then the body 2 is pressed hard towards the body 3 so that the tabs 7 engage in the openings 44 flexing slightly by virtue of the inclined surface 21 which acts as a ramp, the force exerted allowing the surface 22 of the shoulder 24 to get over the tooth 45 at the end of the pushing in movement, by virtue of the spring of the tabs 7, the seal 13 next relaxing slightly so that the play between the tabs 7 and the skirt 31 is completely taken up, the elasticity of the seal 13, which is then compressed, maintaining the locking thus obtained.

It should be noted that the maintaining of the seal in the compressed state allows it to offer excellent sealing between the membrane 4 and the edge of the wall 9, and furthermore, by reaction, between the membrane 4 and the surface 33.

The portion of the membrane 4 situated around the seal 13 is isolated from the outside by virtue of the seal 55. The arched profile of the latter and the ability of the wall 60 to deform, notably during the assembly of the bodies 2 and 3, makes it possible to create a chamber 64 opposite this portion, this chamber protecting this portion of the membrane vis-à-vis contamination by micro-organisms, and notably bacteria, coming from the environment.

In addition, the chamber 64 can collect, during an operation of sampling a liquid under pressure, any discharge from this liquid due to any lateral capillary attraction of the membrane which may remain in spite of the gripping at the seal 13.

Where the sampling relates to a particularly high volume of liquid and/or is effected over a particularly long period, so that the chamber 64 is entirely filled with liquid, the wall 60 which, as indicated above, forms a lip, deforms so that the excess liquid is discharged out of the chamber 64 and then the wall 60 resumes its place, which reconstitutes the protection vis-à-vis the outside: the wall 60 behaves like a kind of overflow valve.

It should be noted that the internal surface of the wall 16 has localized areas of extra thickness 27 (FIG. 3) coming into contact with the external surface of the wall 41, which provides a lateral wedging between these surfaces, which are of similar diameter, and more generally between the bodies 2 and 3.

It should also be noted that, once the device 1 has been assembled in this way, it is possible to package it and sterilize it with a gas such as ETO or by irradiation. By virtue of the slot 63, during sterilisation by gas, the latter enters the chamber 64, which is therefore also sterilised.

Of course, before packaging the assembled device 1 and sterilizing it, each of the pipes 10 and 37 is equipped with a stopper.

There will now be explained how the sampling of a liquid under pressure is carried out with the device 1.

First of all the stopper blocking off one of the pipes 10 and the stopper blocking off the pipe 37 are removed, then the unstoppered pipe 10 is connected to a source of liquid under pressure, for example using a sampling connector having a male Luer tip, which is inserted into the passage of the unstoppered pipe 10 and the valve of the connector is manipulated, so that the chamber formed by the reservoir 5 and the membrane 4 is raised to the same pressure as the liquid, for example 3 bars, the liquid entering the reservoir 5 through the aperture 11 and leaving the reservoir by passing through the membrane 4, which comes to rest on the porous pad 48, the liquid which has passed through the membrane 4 being guided by the channels 39 to the aperture 38, the liquid leaving the device 1 by the pipe 37, a graduated container being preferably disposed under the device 1 in order to recover the liquid coming out of the pipe 37 in order to know when the volume required for the sample has passed through the membrane 4.

When this volume has been reached, the valve on the connector is closed and the device 1 is removed from the latter, then there is put in place, in the unstoppered pipe 10, an air sterilization filter (not depicted), and the drainage of the liquid still present notably in the reservoir 5 is next carried out, by suction through the output aperture 38. Here, in order to effect this drainage, and the unlocking between the intake body 2 and the drainage body 3, the instrument 70 shown in FIGS. 9 to 16 is used.

The instrument 70 has a base 71 with overall the form of a parallelepiped whose opposite corners are cut away by a broad facet 72 and has an active part 73 in the form of a small column erected above the base 71.

The part 73 exhibits overall symmetry of revolution about a vertical axis. It has a base 74, a distribution ring 75 disposed in the base 74, a wheel 76 mounted for rotation with respect to the base 74 and to the distribution ring 75, and a slide 77 mounted for sliding in the axial direction in the wheel 76.

The base 71 is made from sheet metal. On one of its vertical faces there is mounted a coupling 78 whose external part serves for the connection of a pipe connected to a vacuum source represented in FIG. 11 by a vacuum pump 79. The part of the coupling 78 internal to the base 71 cooperates with a butterfly nut 80 used for fixing the coupling 78 whilst there is connected to this internal part a pipe 81 which connects the coupling 78 to a pipe 82 on the base 74.

This has the overall shape of a bowl, from the bottom of which a pipe 82 extends so as to project, the latter having internally a bore which continues through the bottom wall of the base 7. The external wall of the pipe 82 is threaded and cooperates with a butterfly nut 83 serving to fix the active part 73 on the top horizontal wall of the base 71.

The distribution ring 75 has a cylindrical external contour with the same diameter as the internal contour of the base 74. The ring 75 rests on the bottom wall of the base 74 and is immobilised with respect to the latter by means of three screws 84, only one of which is visible in the drawings, the head of each screw 84 engaging on the bottom wall of the base 74 whilst the stem of each screw 84 is engaged in a threaded hole in the ring 75.

A certain number of channels are formed in the thickness of the latter, so that there exist respectively a chamber 85 which communicates with the coupling 78 notably by means of the pipe 82 and pipe 81; and a chamber 86 communicating, through a conduit, not visible, formed in the ring 75 and in the base 74, with the atmosphere, through an air sterilisation filter (not shown).

The wheel 76 has a solid part 87, situated centrally along the axial direction, this solid part having externally knurls 88 which facilitate its gripping by the hand of the user, and has internally a bore in three parts, respectively, from the top, a part 89 having a relatively large diameter, a part 90 with a smaller diameter and a part 91 with an even smaller diameter. The relatively solid part 88 has an outside diameter corresponding to that of the edge of the base 74.

Under the part 87, the wheel 76 has respectively, towards the bottom, a part 82 whose outside diameter corresponds to the inside diameter of the base 74; a part 93 whose outside diameter corresponds to the inside diameter of the ring 75, the part 93 having, over approximately half of its length, at the top, a bore with the same diameter as the bore 91.

The part 93 is entirely engaged in the ring 75. The bottom surface of the part 92 cooperates with the top surface of the ring 75 whilst the external lateral surface of the part 92 cooperates with the base 74, the shoulder existing between the parts 92 and 87 cooperating with the edge of the base 74.

Above the solid part 87 of the ring 76 there is a sheath 94 whose outside diameter corresponds to that of the part 87 and whose inside diameter is larger than that of the part 89 of the bore 87. At regular intervals, orifices 95 are formed at the junction between the part 87 and the sheath 94.

For holding the wheel 76 with respect to the distribution ring 75 and with respect to the base 74, in the axial direction, an elastic ring 96 is provided, disposed around the part 93 of the wheel 76, at the bottom end thereof, this ring bearing on the top surface a countersink which the ring 75 has in its bottom part, this countersink forming part of the chamber 85.

The wheel 76 is thus mounted for rotation with respect to the base 74 and the ring 75. To limit the angular movement of the wheel 76, a key 97 is provided, oriented in the axial direction, fixed to the ring 75, and part of which is engaged in a groove 98, in the form of an angular sector, provided in the part 92 of the ring 6 recessed with respect to its surface, which cooperates with the ring 75, the wheel 76 thus being able to move between two extreme positions corresponding to one or other end of the groove 98 coming into abutment against the key 97.

Figures 9, 10, 11:
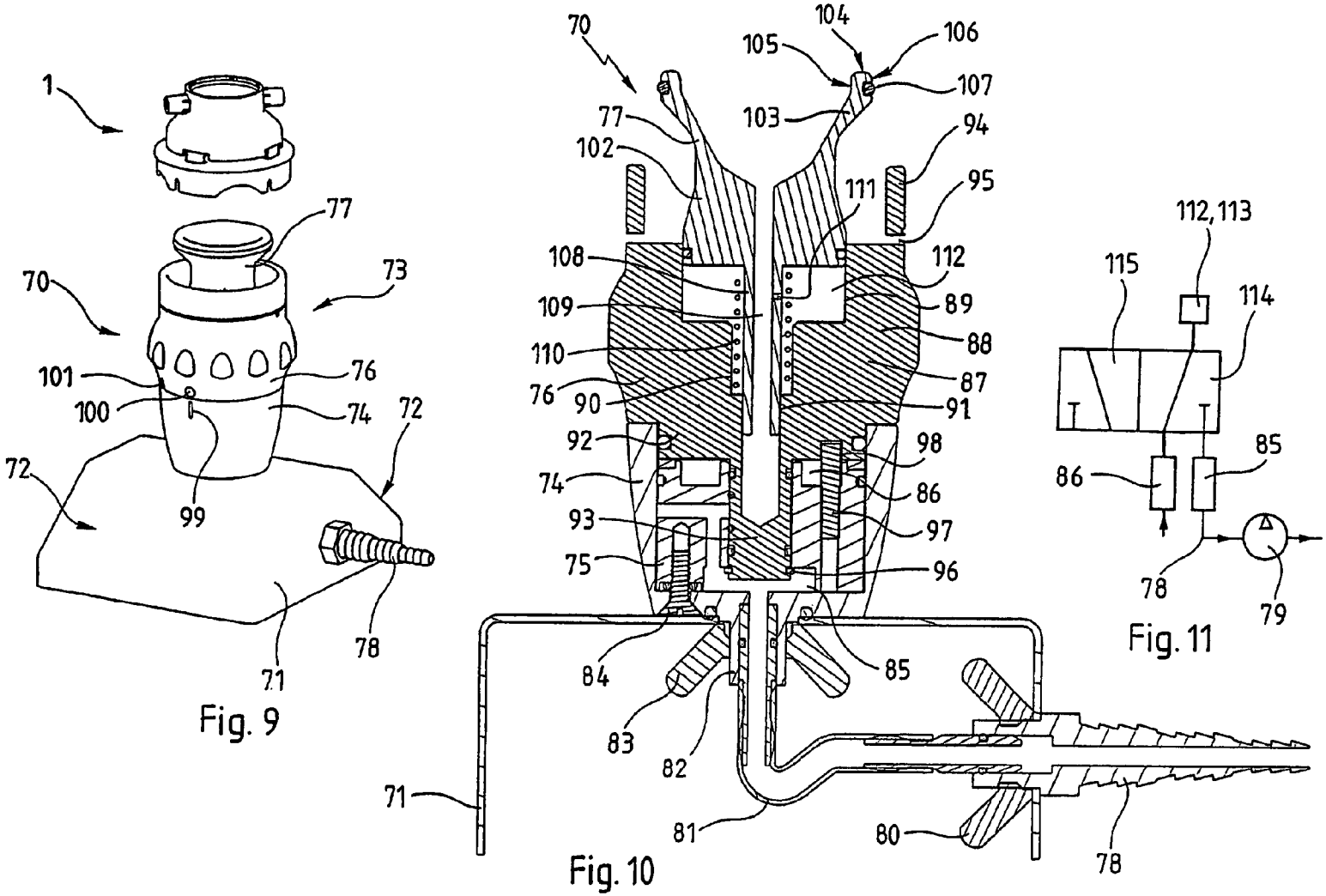
FIG. 9 is a schematic perspective view showing the unlocking instrument according to the invention and the above mentioned device in the course of fitting on this instrument.
FIG. 10 is an elevation view in section of this instrument, in the idle position.
FIG. 11 is a diagram of the pneumatic circuit of this device.

In order to reference these two positions, there are provided, as can be seen in FIG. 9, a mark 99 on the base 74, here in the form of a vertical line, and two marks 100 and 101 on the wheel 76, having respectively the shape of a circle and a vertical line.

The slide 77 has a relatively solid central part 102, whose lateral surface has, at the bottom part, a cylindrical contour with the same diameter as the part 89, the top end of the part 102 being connected to a corolla 103 which opens up from the part 102 as far as its edge 104, which is annular.

The end part of the corolla 103, situated close to the edge 104, has a cylindrical internal surface 105 with the same diameter as the external surface of the rib 40 on the drainage body 3; and has an external cylindrical surface 106 with the same diameter as the internal surface of the wall 41.

In order to provide a seal with respect to the wall 41, for the reasons explained below, the terminal end of the column 103 is provided with an O-ring seal 107 engaged in a groove provided so as to be recessed with respect to the surface 106.

Finally, the slide 77 has, under the part 102, a pipe 108 whose external diameter corresponds to that of the part 91. A bore 109 provided both in the part 102 and in the pipe 108 puts the bottom of the bore provided in the wheel 76 in communication with the volume internal to the corolla 103.

A helical spring 110 is engaged around the pipe 108 and bears respectively against the part 102 of the slide 77 and against the shoulder between the bore parts 90 and 91.

In the pipe 108 there is provided a radial orifice 111 putting the bore 109 and the chamber 112 delimited by the wheel 76 and by the slide 77 in communication.

Figure 12:
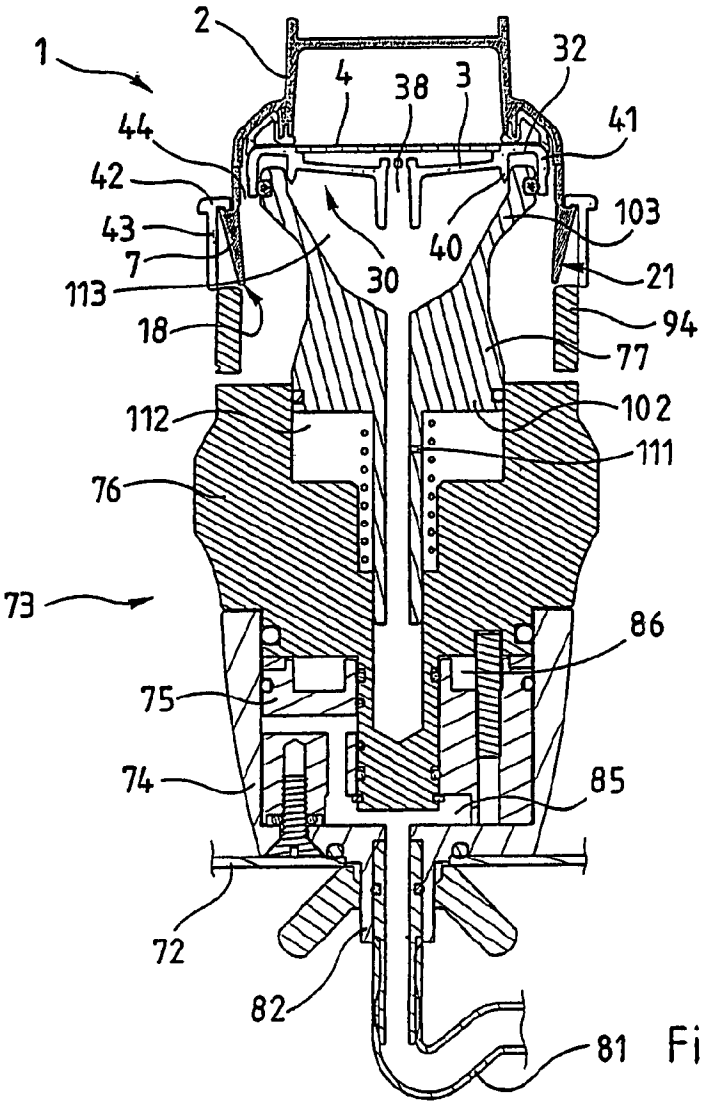
FIG. 12 is a view similar to FIG. 10, but with the unlocking device put in place on the instrument.
Figure 15:
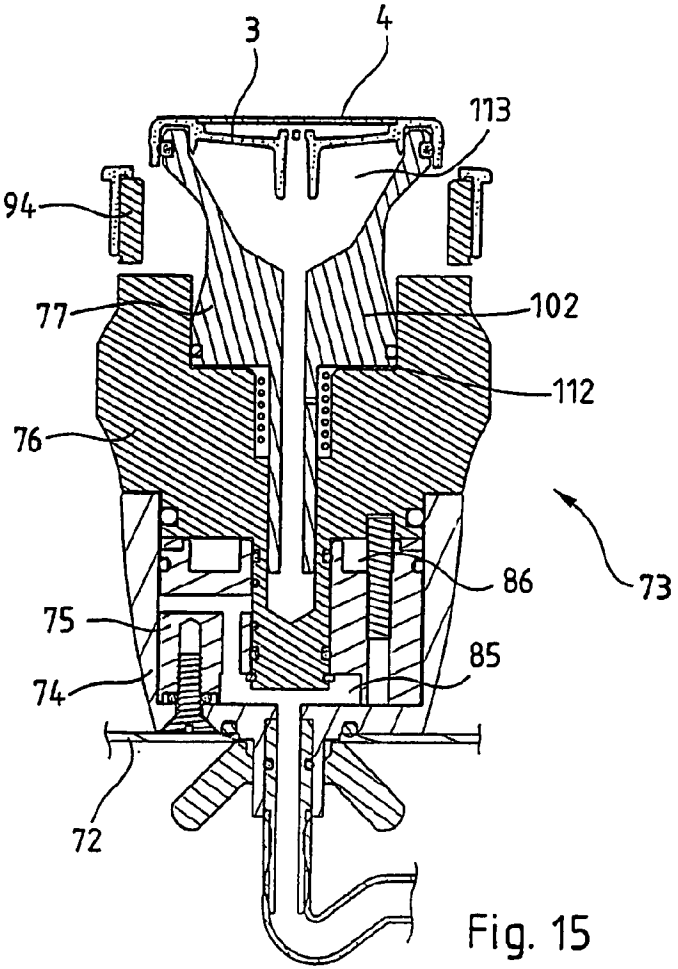
FIG. 15 is a view similar to FIG. 14, but with the intake body which has been removed from the drainage body.

When, as shown in FIG. 12, the device 1 is positioned vis-à-vis the instrument 70 with the terminal end of the corolla 103 engaged in the space delimited by the walls 32, 40 and 41 of the drainage body 3, the table 30 of the latter, made airtight by the moist membrane 4, closes the space internal to the corolla 103, which creates a drainage chamber 113 communicating with the chamber 112 by means of the orifice 111.

FIG. 11 shows diagrammatically the selective connection which exists between the chambers 112 and 113 and, respectively, the chamber 86 and the chamber 85, depending on whether the wheel 76 is in one or other of its end of travel positions, by virtue of the selective distribution means constituted by the distribution ring 75 and the tab 93, in the wall of which suitable orifices (not visible) are provided.

The idle position, in which the mark 100 is opposite the mark 99, is shown by the box 114 in FIG. 11. It can be seen that, in this position, the chambers 112 and 113 are isolated from the chamber 85, and therefore from the vacuum source 79, whilst they are put in communication with the chamber 86, which communicates with atmosphere.

In the other end-of-travel position, which is the working position, it is the mark 101 which is opposite the mark 99, the chambers 112 and 113 are isolated from the atmosphere and are in communication with the chamber 85 itself communicating with the vacuum source 79.

The vacuum existing in the chamber 113 makes it possible, as will be explained now in more detail, to drain the device 1 whilst the vacuum existing in the chamber 112 makes it possible to assist the pressing in of the slide 77 with respect to the wheel 76, the part 102 behaving like a piston.

Once a liquid to be examined has been sampled with the device 1, this device is positioned opposite the instrument 70, as shown in FIG. 12.

As indicated above, the space delimited by the walls 32, 40 and 41 is positioned on the terminal end of the corolla 103. Because of the relative arrangement, in the idle position, of the slide 77 vis-à-vis the sheath 94, the device 1 is thereby positioned vis-à-vis the sheath 94, whose outside diameter corresponds to the inside diameter of the wall 43, and whose thickness corresponds substantially to the distance existing, when the bodies 2 and 3 are locked on each other, between the internal surface of the wall 43 and the free end 18 of the tabs 7.

The wheel 76 is next manoeuvred in order to place it in the working position (mark 101 opposite the mark 99), so that the vacuum forms in the chambers 112 and 113.

This has the effect of completing the fitting of the device 1 on the slide 77, the terminal end of the corolla 103 being pressed in until the edge 104 comes against the wall 32.

The difference in pressure between the chamber 112 and the space existing at the periphery of the slide 77, a space which communicates with the atmosphere, is not sufficient, having regard to the difference in cross-section, to overcome the resistive force applied by the spring 110, so that the slide 77 remains in place.

The chamber 113 constitutes a suction chamber, into which the outlet orifice 38 opens out, through which therefore the liquid present in the device 1 is discharged.

Once the drainage has been effected, the operator presses on the device 1. As a result the slide 77 sinks into the wheel 76, in which it is assisted by virtue of the vacuum prevailing in the chamber 112.

Figure 13:
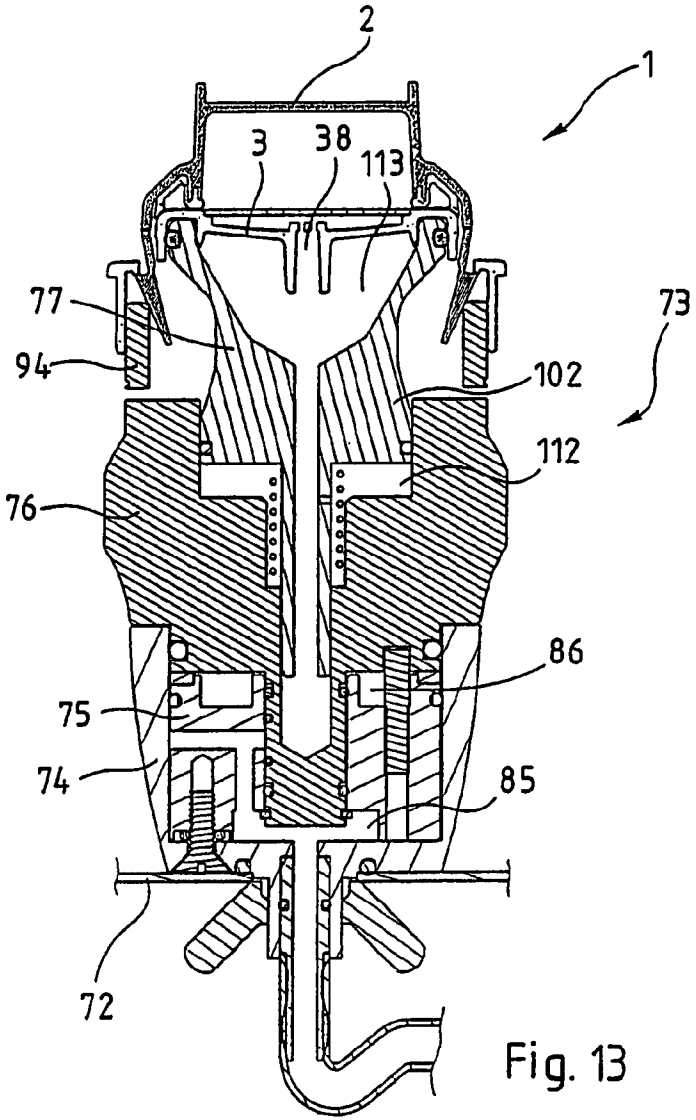
FIGS. 13 and 14 show respectively an intermediate position and the unlocking position of the device.

At the same time as the slide 77 sinks into the ring 76, the sheath 94 enters between the wall 43 and the tabs 7, cooperating with the inclined external surface 21 of the latter. This has the effect, as shown in FIG. 13, of causing the tabs 7 to tilt inwards until the means which prevent the withdrawal of the tabs 7 are released, each tab 7 in this case escaping from the corresponding tooth 45.

Figure 14:
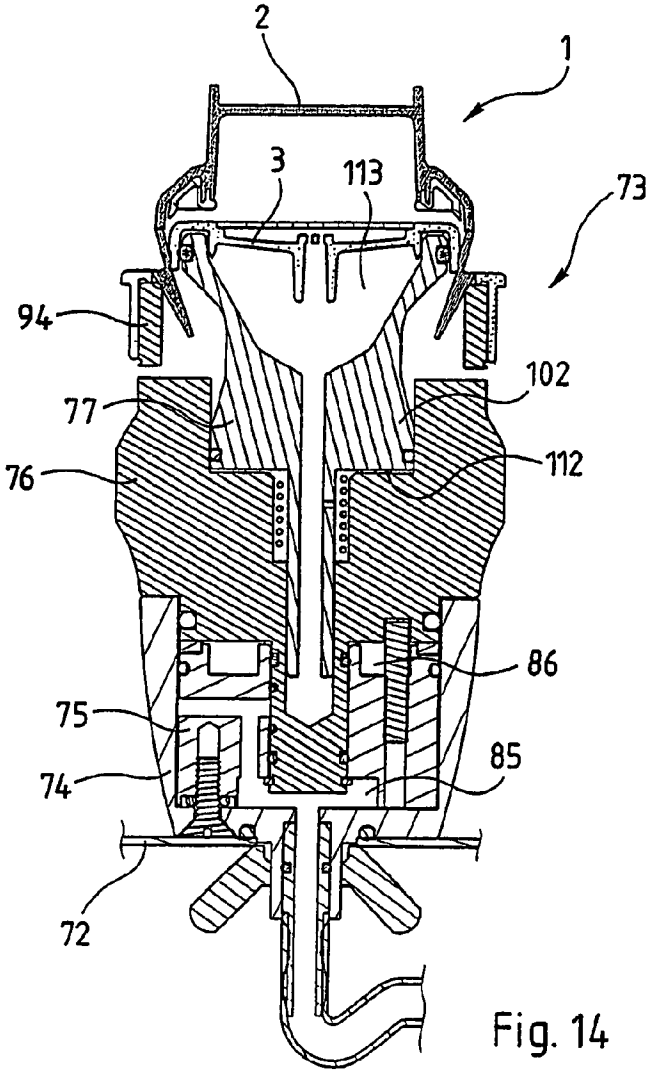

As shown in FIG. 14, the sinking in of the sheath 94 continues until it comes into abutment against the teeth 45, the lugs 7 then having their area of connection with the skirt 6 situated in the corresponding aperture 44. It then suffices to exert a traction on the inlet body 2 in order to separate from the drainage body 3, the tabs 7 being sufficiently flexible to curve in order to allow this extraction movement.

Figure 17:
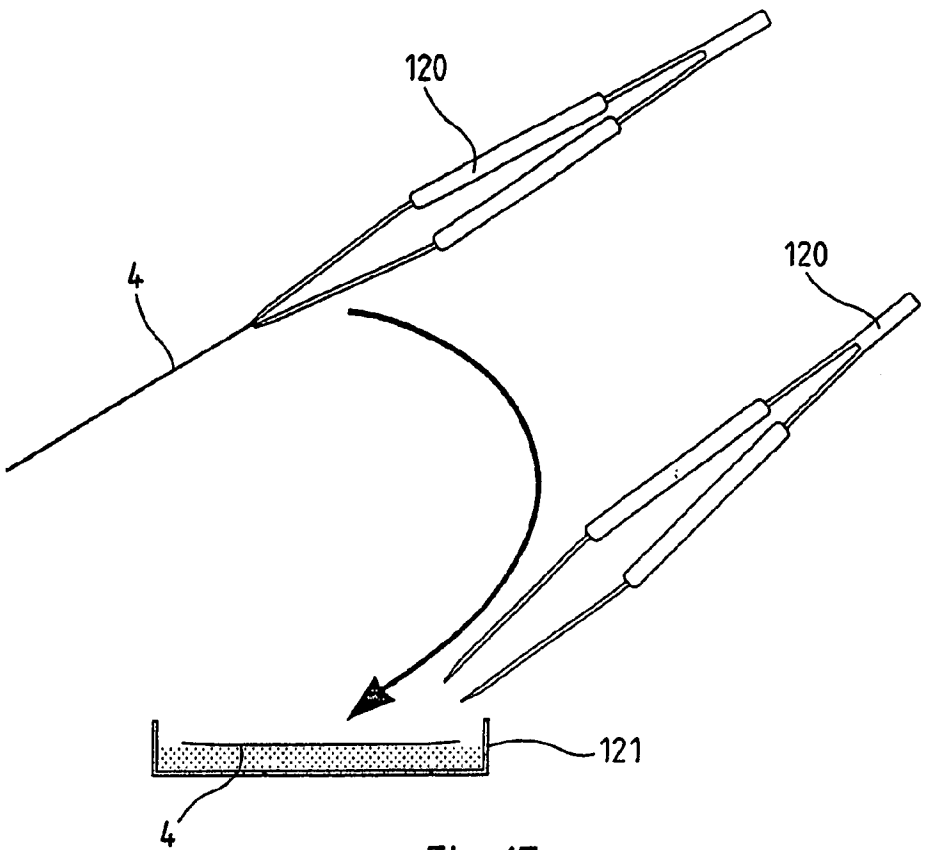
FIG. 17 shows how the recovered membrane is placed in a Petri dish.
Figure 16:
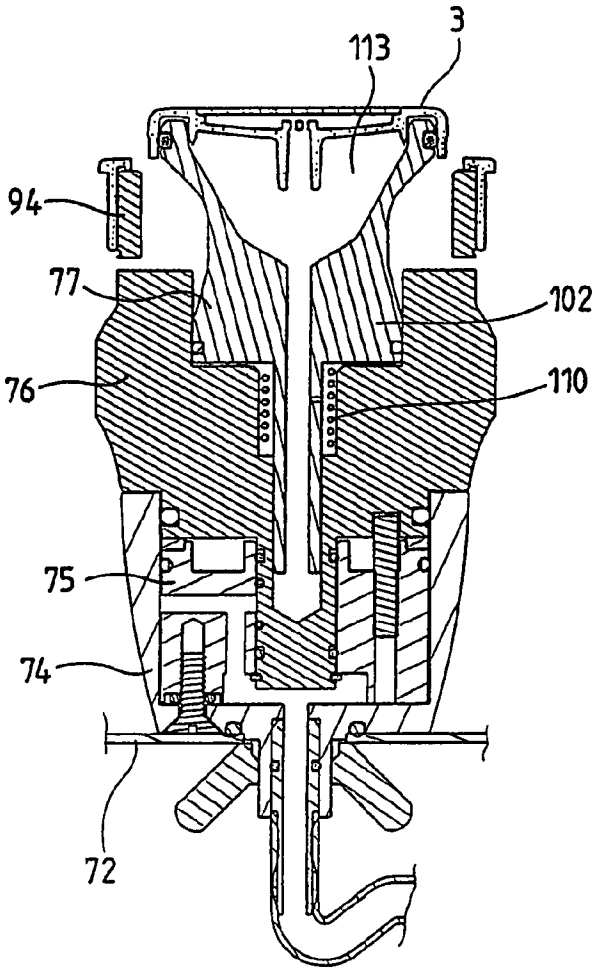
FIG. 16 is a view similar to FIG. 5, but with the membrane which has just been recovered by means of tweezers.

Once the inlet body 2 has been removed, it is possible to recover the membrane (FIG. 16) by means of tweezers 120 and then, as shown in FIG. 17, to place the membrane 4 in a Petri dish 121, the whole then being put to incubate in a conventional fashion.

It should be noted that the vacuum which was present in the chamber 113 procured a holding of the membrane 4 on the drainage body 3 after the removal of the inlet body 2, which was able to be taken off with only one hand by virtue of the holding, procured by the vacuum, of the drainage body 3 on the guidance means 77. The possibility of separating the inlet body 2 and the drainage body 3 with only one hand is advantageous since it enables the operator to hold the tweezers 120 with the other hand and to recover the membrane as soon as the device 1 is opened.

The removal of the membrane 4 from the body 3 has the effect of opening the chamber 113 to atmosphere, so that the slide 77 is returned to its initial position by the spring 110 and the body 3 can be removed from the slide 77.

To use the instrument 70 once again, it is possible to place another device 1 directly on the slide 77. When the instrument 70 is ceased to be used, the wheel 77 is returned to the idle position (mark 100 opposite the mark 99).

In a variant which is not shown, the selective distribution means constituted by the ring 75 and the part 93 serve simply to connect the chambers 112 and 113 to the chamber 85 or to isolate them from it, without the chambers 112 and 113 being put in communication with the chamber 86 in the isolation position, the opening to atmosphere of these chambers taking place simply by the removal of the membrane 4.

In another variant which is not shown, the part 102 of the slide 77 and the chamber 112 are sized so that, when the vacuum is present in the chamber 112, there is not a simple assistance for the pushing in of the slide 77 but an effect of driving with sufficient force to reach as far as the end of travel position illustrated in FIG. 14. The wheel 76 is then replaced by another wheel having three positions: an idle position in which the communication of the chambers 112 and 113 with the vacuum is cut, a position in which the communication with the vacuum takes place by means of a restriction, this position serving to effect the draining, and finally a third position in which the communication with the vacuum is direct, this last position serving to effect the opening operation.

In yet other variants which are not shown, the instrument 70 is replaced by a simple sheath similar to the sheath 94, in order to unlock the tabs 7; the sheath 94, formed by a continuous cylindrical surface, is replaced by a sheath which is similar but with solid portions separated by voids, each solid portion being adapted to be housed between a tab 7 and the wall 43. Both an unlocking sheath and guidance means are provided, but without connection with the vacuum in order to drain the device and assist the pushing-in movement; and/or a means of connection to the vacuum is provided, but only to drain the device to be opened.

Many other variants are possible depending on circumstances, and it should be stated in this respect that the invention is not limited to the examples described and depicted.

The invention claimed is:

1. A method for unlocking a device having a first body and a second body provided with means of mutual locking by axial latching, said mutual locking means having:

on said first body, a plurality of axially oriented projecting latching tabs;

on said second body, a transversely oriented wall provided, for each one of said latching tabs, with an aperture through which a latching tab can pass, said transversely oriented wall joining a cylindrical wall faced by said latching tabs when said first body and second body are locked on each other; and means for preventing the withdrawal of each latching tab which has passed through said aperture;

the method characterised in that it includes:

a) the step of positioning said device on a sheath having, for each one of said tabs, a portion adapted to be housed between a tab and said cylindrical wall, b) the step of making each portion of said sheath enter between a tab and cylindrical wall so that each said portion cooperates with said tab in order to cause it to tilt radially inwardly until said means for preventing withdrawal are released; and c) the step of separating said first body and second body from each other.

2. The method according to claim 1, characterised in that said sheath is formed by a continuous cylindrical wall.

3. The method according to either one of claim 1 or 2, wherein said means for preventing the withdrawal of each latching tab which has passed through said aperture have, on said transversely oriented wall of said second body, an axially oriented tooth bordering said aperture on a side of said cylindrical wall and have, on each one of said latching tabs, a groove adapted to house said tooth; and in that, in said step b), each one of said tabs tilts so that it escapes from said tooth and in that finally its joining region with the rest of said first body is located in said aperture.

4. The method according to any one of claim 1 or 2, wherein said sheath forms part of an unlocking instrument also having a guidance means adapted to move with respect to said sheath in an axial direction, in that said step a) includes a step of positioning said second body on said guidance means and in that said step b) includes a movement of said guidance means with respect to said sheath in order to guide, with respect to said sheath, the second body, and therefore the cylindrical wall, in the axial direction.

5. The method according to claim 4, wherein said unlocking instrument has means for at least assisting the movement of said guidance means during step b).

6. The method according to claim 5, wherein said unlocking instrument has means of connection to a vacuum source, a piston means forming part of the guidance means, a drive chamber delimited at one end by said piston means and distribution means for selectively connecting said drive chamber to said vacuum source or to isolate it from it; and in that said step a) is effected with said distribution means isolating said drive chamber from said vacuum source whilst said step b) is effected with said distribution means connecting said drive chamber to the vacuum source.

7. The method according to claim 4, wherein said second body has a table surrounded by said transversely oriented wall, and provided at its centre with a drainage orifice; and in that said guidance means has a suction chamber adapted, when said second body is in place on said guidance means, to be closed by said table with said drainage orifice opening out in said suction chamber; and in that said unlatching instrument has means of connection to a vacuum source and distribution means for selectively connecting said suction chamber to said vacuum source or to isolate it from it; and in that said method includes the step of connecting said suction chamber to said vacuum source in order to drain said device before unlocking.

8. The method according to claim 4, wherein said second body has a table with a first cylindrical wall and a second cylindrical wall disposed coaxially and extending opposite to the first body when it is locked on to the second body, and having a transversely oriented annular wall whose external end and internal end are connected respectively to the first cylindrical wall and the second cylindrical wall; in that said guidance means has a wall whose rim close to the edge is adapted to be housed in the space delimited by said transversely oriented annular wall and said first cylindrical wall and second cylindrical wall; and in that said step a) includes the step of engaging said rim close to the edge in said space.

9. The method according to any one of claim 1 or 2, wherein said device is a device for the microbiological examination of a sample of liquid under pressure, said first body being an inlet body, said second body being a drainage body, a membrane being held between the inlet body and the drainage body, and in that said method includes, after said step c), the step of recovering said membrane and disposing it ma Petri dish.

10. An instrument for unlocking a device having a first body and a second body provided with means of mutual locking by axial latching, said mutual locking means including:

on said first body, a plurality of axially oriented projecting latching tabs;

on said second body, a transversely oriented wall provided for each one of said latching tabs with an aperture through which each one of said latching tabs can pass, said transversely oriented wall joining a cylindrical wall faced by said latching tabs when said first body and second body are locked on each other; and means for preventing the withdrawal of each latching tab which has passed through said aperture;

the instrument characterised in that it has:

a sheath having, for each one of said tabs, a portion adapted to be housed between a tab and said cylindrical wall, and adapted, when it enters between the tab and said cylinder wall, to cooperate with said tab to cause it to tilt until said means for preventing withdrawal are released; and a guidance means, adapted to receive said second body and adapted to move with respect to said sheath in an axial direction, in order to guide, with respect to said sheath, the second body, and therefore the cylindrical wall, in the axial direction.

11. The instrument according to claim 10, wherein said sheath is formed by a continuous cylindrical wall.

12. The instrument according to claim 10, further comprising means for at least assisting the movement of said guidance means.

13. The instrument according to claim 12, wherein said unlocking instrument has means of connection to a vacuum source, a piston means forming part of the guidance means, a drive chamber delimited at one end by said piston means and distribution means for selectively connecting said drive chamber to said vacuum source or to isolate it from it.

14. The instrument according to claim 10, wherein said guidance means has a suction chamber adapted, when said second body is in place on said guidance means, to be closed off by a table of said second body, a drainage orifice for said device, provided in said table, opening out in said suction chamber; and in that said unlocking instrument has means of connection to a vacuum source and distribution means for selectively connecting said suction chamber to said vacuum source or to isolate it from it.

15. The instrument according to claim 10, wherein said guidance means has a wall whose rim close to an edge is annular.

16. The instrument according to claim 15, wherein said guidance means has a corolla which spreads out as far as said edge.

17. The instrument according to claim 10, further comprising a wheel provided at one end of the said sheath and slidably receiving said guidance means.

18. The instrument according to claim 17, wherein said guidance means has a central part with, at the bottom part of its lateral surface, a cylindrical contour with the same diameter as a part of a bore which said wheel has.

19. The instrument according to claim 18, wherein said guidance means has a pipe whose outside diameter corresponds to that of a part of a bore of said wheel.

20. The instrument according to claim 19, wherein a spring is engaged around said pipe and bears respectively against said central part of said guidance means and against a shoulder of said wheel situated at one end of said bore part of the bore with a diameter corresponding to that of said pipe.

21. The instrument according to claim 17, further comprising a base provided with a distribution ring with said wheel being mounted for rotation with respect to the assembly formed by the base and the distribution ring.

22. The instrument according to claim 21, wherein said base and said distribution ring delimit a first chamber communicating with a coupling to a vacuum source, and a second chamber communicating with the atmosphere.

23. The instrument according to claim 22, wherein said wheel has a part whose outside diameter corresponds to the inside diameter of said distribution ring, said part having a bore extending the bore of a solid part of said wheel.

24. The instrument according to claim 23, wherein said wheel affords, with respect to the assembly formed by the base and said distribution ring, a first position and a second position in which the bore of the said part engaged in said distribution ring is in communication respectively with the said first chamber and with the said second chamber.

25. A method for unlocking a device having a first body and a second body provided with means of mutual locking by axial latching, said mutual locking means having:

on said first body, a plurality of axially oriented projecting latching tabs;

on said second body, a transversely oriented wall provided, for each one of said latching tabs, with an aperture through which a latching tab can pass, said transversely oriented wall joining a cylindrical wall faced by said latching tabs when said first body and second body are locked on each other; and means for preventing the withdrawal of each latching tab which has passed through said aperture;

the method characterised in that it includes:

a) the step of positioning said device on a sheath having, for each one of said tabs, a portion adapted to be housed between a tab and said cylindrical wall, b) the step of making each portion of said sheath enter between a tab and cylindrical wall so that each said portion cooperates with said tab in order to cause it to tilt until said means for preventing withdrawal are released; and c) the step of separating said first body and second body from each other;

wherein said sheath forms part of an unlocking instrument also having a guidance means adapted to move with respect to said sheath in an axial direction, in that said step a) includes a step of positioning said second body on said guidance means and in that said step b) includes a movement of said guidance means with respect to said sheath in order to guide, with respect to said sheath, the second body, and therefore the cylindrical wall, in the axial direction.

26. The method according to claim 25, wherein said unlocking instrument has means for at least assisting the movement of said guidance means during step b).

27. The method according to claim 26, wherein said unlocking instrument has means of connection to a vacuum source, a piston means forming part of the guidance means, a drive chamber delimited at one end by said piston means and distribution means for selectively connecting said drive chamber to said vacuum source or to isolate it from it; and in that said step a) is effected with said distribution means isolating said drive chamber from said vacuum source whilst said step b) is effected with said distribution means connecting said drive chamber to the vacuum source.

28. The method according to claim 25, wherein said second body has a table surrounded by said transversely oriented wall, and provided at its centre with a drainage orifice; and in that said guidance means has a suction chamber adapted, when said second body is in place on said guidance means, to be closed by said table with said drainage orifice opening out in said suction chamber; and in that said unlatching instrument has means of connection to a vacuum source and distribution means for selectively connecting said suction chamber to said vacuum source or to isolate it from it; and in that said method includes the step of connecting said suction chamber to said vacuum source in order to drain said device before unlocking.

29. The method according to claim 25, wherein said second body has a table with a first cylindrical wall and a second cylindrical wall disposed coaxially and extending opposite to the first body when it is locked on to the second body, and having a transversely oriented annular wall whose external end and internal end are connected respectively to the first cylindrical wall and the second cylindrical wall; in that said guidance means has a wall whose rim close to the edge is adapted to be housed in the space delimited by said transversely oriented annular wall and said first cylindrical wall and second cylindrical wall; and in that said step a) includes the step of engaging said rim close to the edge in said space.

* * * * *